US009311874B2

(12) United States Patent
Ahn et al.

(10) Patent No.: US 9,311,874 B2
(45) Date of Patent: Apr. 12, 2016

(54) POWER CONNECTION STRUCTURE OF DRIVER IC CHIP

(75) Inventors: Yong Sung Ahn, Ansan-si (KR); Jong Soo Lee, Cheongju-si (KR); Yu Na Shin, Cheongju-si (KR); Yong Suk Kim, Daegu-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 708 days.

(21) Appl. No.: 13/081,043

(22) Filed: Apr. 6, 2011

(65) Prior Publication Data

US 2011/0248972 A1 Oct. 13, 2011

(30) Foreign Application Priority Data

Apr. 13, 2010 (KR) ..... 10-2010-0033780

(51) Int. Cl.
*G09G 3/36* (2006.01)

(52) U.S. Cl.
CPC ..... *G09G 3/3648* (2013.01); *G09G 2300/0413* (2013.01); *G09G 2300/0426* (2013.01); *G09G 2320/0223* (2013.01); *G09G 2330/02* (2013.01)

(58) Field of Classification Search
CPC ..... G09G 3/3648; G09G 2320/0223; G09G 2330/02; G09G 2300/0413; G09G 2300/0426
See application file for complete search history.

(56) References Cited

U.S. PATENT DOCUMENTS

2006/0232579 A1* 10/2006 Chen et al. ..... 345/211
2009/0195490 A1* 8/2009 Imajo et al. ..... 345/94
2010/0110058 A1* 5/2010 Moh et al. ..... 345/211

FOREIGN PATENT DOCUMENTS

JP 2004-146806 5/2004
KR 10-2000-0036239 6/2000
KR 10-2005-0000994 1/2005

* cited by examiner

*Primary Examiner* — Amr Awad
*Assistant Examiner* — Andre Matthews
(74) *Attorney, Agent, or Firm* — Kile Park Reed & Houtteman PLLC

(57) ABSTRACT

A power connection structure of a driver IC chip including a first power terminal unit formed on one side thereof, a second power terminal unit formed on the other side thereof, and a dummy power terminal unit formed between the first power terminal unit and the second power terminal unit. The driver IC chip is mounted to a liquid crystal panel of a liquid crystal display device in a chip-on-glass (COG) type. Both of the first power terminal unit and the dummy power terminal unit and both of the dummy power terminal unit and the second power terminal unit are connected through routing lines in the driver IC chip.

5 Claims, 2 Drawing Sheets

POWER CONNECTION STRUCTURE OF DRIVER IC CHIP

BACKGROUND OF THE INVENTION

1. Field of the Invention

The present invention relates to a power connection structure of a driver IC (integrated circuit) chip, and more particularly, to a power connection structure of a driver IC chip, in which routing patterns in a driver IC chip are disposed parallel to LOG (line-on-glass) type lines to connect power terminal units disposed on both ends of the driver IC chip, thereby simplifying wiring lines and reducing line resistance.

2. Description of the Related Art

A liquid crystal display (LCD) means a device which uses a characteristic that an aligned state of liquid crystal molecules is changed depending upon an applied voltage and image data is displayed by passing light through liquid crystals. Recently, a most actively used device among liquid crystal displays is a thin film transistor type liquid crystal display (TFT-LCD) which is made by using a silicon IC manufacturing technology.

FIG. 1 is a diagram schematically illustrating the structure of a conventional liquid crystal display.

The TFT-LCD includes a liquid crystal display panel 30 in which a thin film transistor array substrate and a color filter substrate are attached to each other with a predetermined space defined therebetween and liquid crystals are disposed in the predetermined space, and driving circuits for driving the liquid crystal display panel 30.

The driving circuits includes a gate driver IC 40 configured to sequentially apply scanning signals to gate lines in each frame, a source driver IC 20 configured to drive source lines in correspondence to the scanning signals from the gate driver IC, a timing controller 10 configured to control the gate driver IC 40 and the source driver IC 20 and output pixel data, and a power supply unit (not shown) configured to supply various driving voltages to be used in a liquid crystal display device.

In general, methods for connecting the driver ICs with the liquid crystal panel include a TAB (tape automated bonding) type in which the driver ICs are mounted to a thin flexible film made of a polymer substance, that is, a TCP (tape carrier package) and the film is connected with the liquid crystal panel to electrically connect the driver ICs with the liquid crystal panel, and a COG (chip-on-glass) type in which the driver ICs are directly mounted to the glass substrate of the liquid crystal panel by using bumps and are thereby connected to the liquid crystal panel.

In the COG type, a method is used, in which the output electrodes of the driver ICs are directly connected to pads to integrate the substrate and the driver ICs. In the COG type, when performing a process for bonding the bumps and the pads, the bumps and the pads are bonded with each other by conductive particles which are disposed between the bumps and the pads.

In the COG type, the driver IC chips mounted to the liquid crystal panel are connected with one another in a line-on-glass (LOG) type in which signal lines are directly disposed on the thin film transistor array substrate, and are supplied with control signals and the driving voltages from the timing controller and the power supply unit.

FIG. 2 is a diagram illustrating a power connection structure of a driver IC chip which is mounted in a COG type generally known in the art.

Referring to FIG. 2, in the case of a driver IC chip, it is the norm that the driver IC chip has a rectangular shape in which a transverse length is substantially longer than a longitudinal length due to the characteristics of a liquid crystal display application. If a power source is disposed only in one side of the driver IC chip, since signals may become weak on the other side with no power source, operational problems may be caused.

Accordingly, in a driver IC chip 200 which is mounted in the conventional COG type, internal circuits 230 are centrally disposed, and power terminal units 210 and 220 are respectively disposed on both sides of the driver IC chip, so that operational problems due to signal damping can be solved.

However, because the power sources disposed on both sides of the driver IC chip should be connected with each other by separate connection lines on flexible printed circuits (FPCs), input/output wiring lines become complicated on the FPCs. Also, since the wiring lines are added, economy may deteriorate.

Moreover, in the conventional COG mounting type, a disadvantage is caused in that a voltage drop is likely to occur due to inherent resistance of a signal or power supply line composed of a metal line.

SUMMARY OF THE INVENTION

Accordingly, the present invention has been made in an effort to solve the problems occurring in the related art, and an object of the present invention is to provide a power connection structure of a driver IC chip, in which routing patterns in a driver IC chip are disposed parallel to LOGs (lines-on-glass) to connect power terminal units disposed on both ends of the driver IC chip, thereby simplifying wiring lines and reducing line resistance.

In order to achieve the above object, according to one aspect of the present invention, there is provided a power connection structure of a driver IC chip including a first power terminal unit formed on one side thereof and a second power terminal unit formed on the other side thereof and mounted to a display panel of a display device in a chip-on-glass (COG) type, wherein both of the first power terminal unit and the second power terminal unit are connected with each other through routing lines in the driver IC chip, are connected with each other through LOG (line-on-glass) type lines on the display panel, and the routing lines and the LOG type lines are disposed parallel to each other.

In the power connection structure of a driver IC chip according to the present invention, since the number of wiring lines of input/output terminals of a driver IC chip is decreased, wiring lines can be simplified, and due to this fact, the size of the driver IC chip and the manufacturing cost thereof can be reduced.

Also, in the present invention, advantages are provided in that, since routing patterns in the driver IC chip are disposed in parallel to LOGs to connect power terminal units with each other, line resistance can be reduced and signal delay can be diminished.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Figure 1:
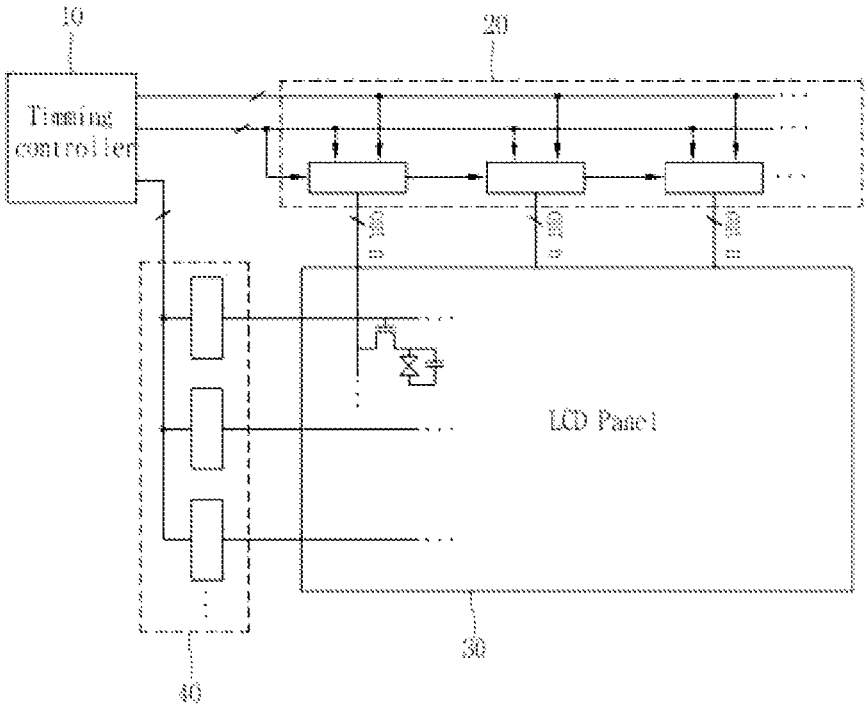
FIG. 1 (PRIOR ART)
FIG. 1 is a diagram schematically illustrating the structure of a conventional liquid crystal display.
Figure 2:
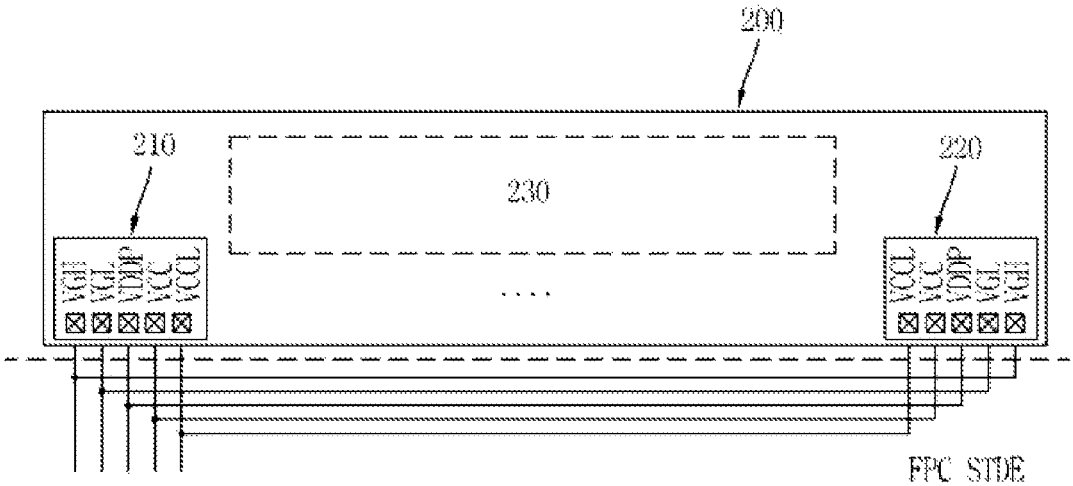
FIG. 2 (PRIOR ART)
FIG. 2 is a diagram illustrating a power connection structure of a driver IC chip which is mounted in a COG type generally known in the art.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 3:
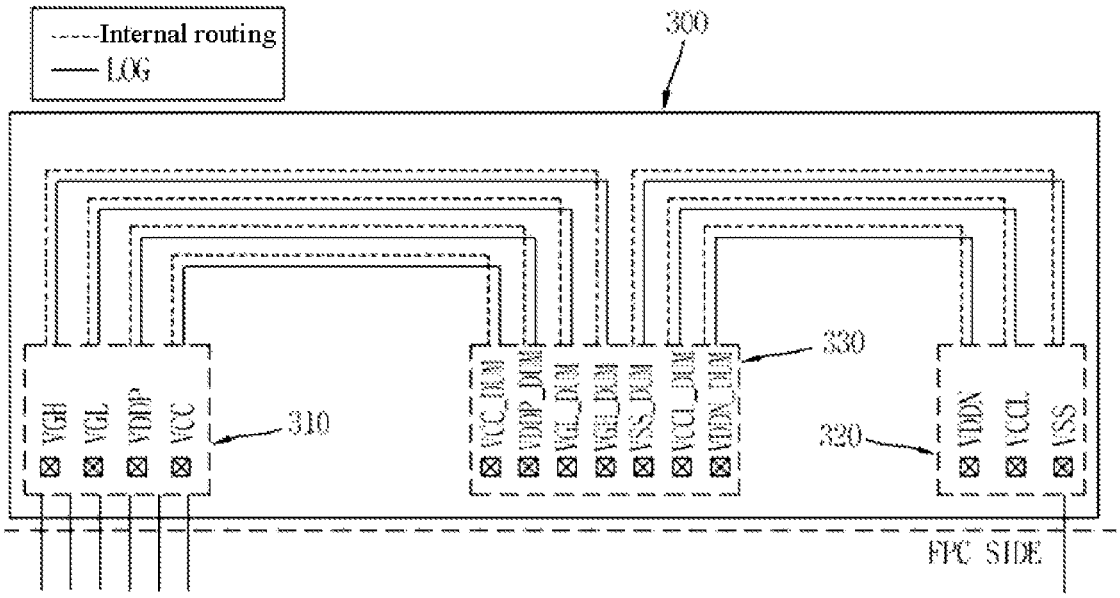
FIG. 3 is a diagram illustrating a power connection structure of a driver IC chip in accordance with an embodiment of the present invention.

FIG. 3 is a diagram illustrating a power connection structure of a driver IC chip in accordance with an embodiment of the present invention.

Referring to FIG. 3, in the embodiment of the present invention, a driver IC chip 300 includes a first power terminal unit 310 formed on one side thereof, a second power terminal unit 320 formed on the other side thereof, and a dummy power terminal unit 330 formed between the first power terminal unit 310 and the second power terminal unit 320.

The first power terminal unit 310 and the second power terminal unit 320 include power terminals VGH and VGL for supplying gate driving voltages or power terminals VDDP, VCC, VCCL and VSS for supplying source driving voltages.

The power terminals VGH and VGL for supplying gate driving voltages may be disposed in the first power terminal unit 310, and the power terminals VDDP, VCC, VCCL and VSS for supplying source driving voltages may be disposed in the second power terminal unit 320.

Also, it may be contemplated that the power terminals VGH and VGL for supplying gate driving voltages and the power terminals VDDP, VCC, VCCL and VSS for supplying source driving voltages may be randomly disposed in the first power terminal unit 310 and the second power terminal unit 320.

The dummy power terminal unit 330 includes dummy power terminals VGH_DUM, VGL_DUM, VDDP_DUM, VCC_DUM, VCCL_DUM and VSS_DUM which are connected with the first power terminal unit 310 or the second power terminal unit 320 by routing lines and LOG (line-on-glass) type lines in the driver IC chip 300.

Referring to FIG. 3, in the power connection structure of a driver IC chip in accordance with the embodiment of the present invention, it can be seen that the first power terminal unit 310 and the second power terminal unit 320 of the driver IC chip 300 are connected with each other via the dummy power terminal unit 330 by the routing lines and the LOG type lines in the driver IC chip 300.

Here, the routing lines indicate wiring lines for connecting a conductive material, such as aluminum and polysilicon, for transferring electric signals in the driver IC chip 300, to circuit elements. Since the routing lines are well known in the art, detailed description thereof will be omitted herein.

Meanwhile, in the case where the driver IC chip 300 is mounted to a display panel in a chip-on-glass (COG) type, the first power terminal unit 310 and the second power terminal unit 320 of the driver IC chip are connected with each other in an LOG type via the dummy power terminal unit 330 by the LOG type lines. Since the LOG type is well known in the art, detailed description thereof will be omitted herein.

The routing lines and the LOG type lines of the driver IC chip are disposed parallel to each other.

That is to say, in the power connection structure of a driver IC chip in accordance with the embodiment of the present invention, the routing lines and the LOG type lines of the driver IC chip are connected parallel to each other and the first power terminal unit 310 and the second power terminal unit 320 are connected via the dummy power terminal unit 330. As a consequence, the wiring lines of an FPC (flexible printed circuit) can be decreased and thereby a chip size can be reduced.

As is apparent from the above description, in the power connection structure of a driver IC chip according to the present invention, routing lines and LOG type lines of a driver IC chip for connection of a first power terminal unit and a second power terminal unit are disposed parallel to each other. Due to this fact, line resistance between the first power terminal unit and the second power terminal unit can be reduced.

Further, as the line resistance between the first power terminal unit and the second power terminal unit is reduced, an additional advantage is provided in that signal delay can be diminished.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A power connection structure of a driver integrated circuit chip, the driver integrated circuit chip comprising:

a chip-on-glass type mounting to a display panel of a display device;

a first side;

a second side opposite the first side along a transverse length;

a first power terminal unit disposed within the driver integrated circuit chip adjacent the first side;

a second power terminal unit disposed within the driver integrated circuit chip adjacent the second side and spaced from the first power terminal unit;

a dummy power terminal unit disposed within the driver integrated circuit chip between the first power terminal unit and the second power terminal unit; and a plurality of routing lines extending between the first power terminal unit and the dummy power terminal unit and extending between the second power terminal unit and the dummy terminal unit, the plurality of routing lines disposed completely within the driver integrated circuit chip, wherein the first power terminal unit is directly connected to the dummy power terminal unit through at least one of the plurality of routing lines, and the second power terminal unit is directly connected to the dummy power terminal unit through at least one of the plurality of routing lines.

2. The power connection structure according to claim 1, wherein the driver integrated circuit chip further comprises a plurality of line-on-glass type lines extending between the first power terminal unit and the dummy power terminal unit and extending between the second power terminal unit and the dummy terminal unit, and the plurality of line-on-glass type lines disposed on the display panel, wherein the first power terminal unit is connected to the dummy terminal unit through at least one of the plurality of line-on-glass type lines, and the second power terminal unit is connected to the dummy power terminal unit through at least one of the plurality of line-on-glass type lines.

3. The power connection structure according to claim 2, wherein the plurality of routing lines and the plurality of line-on-glass type lines in the driver integrated circuit chip are disposed parallel to each other.

4. The power connection structure according to claim 3, wherein each of the first power terminal unit and the second power terminal unit includes a power terminal for supplying a gate driving voltage or a power terminal for supplying a source driving voltage.

5. The power connection structure according to claim 2, wherein the plurality of line-on-glass type lines are directly disposed on a glass substrate of the display panel, and the plurality of routing lines are directly disposed in the driver integrated circuit chip which is directly mounted on the glass substrate.

* * * * *